US009427955B2

(12) United States Patent
Gracia Verdugo et al.

(10) Patent No.: US 9,427,955 B2
(45) **Date of Patent: *Aug. 30, 2016**

(54) TO CONTROL A PRINTER CARRIAGE

(71) Applicant: Hewlett-Packard Development Company, L.P., Houston, TX (US)

(72) Inventors: Antonio Gracia Verdugo, Barcelona (ES); Gonzalo Gaston Llado, Barcelona (ES); Oriol Borrell Avila, Sabadell (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/919,476

(22) Filed: Oct. 21, 2015

(65) Prior Publication Data

US 2016/0039198 A1 Feb. 11, 2016

Related U.S. Application Data

(63) Continuation of application No. 13/873,783, filed on Apr. 30, 2013, now Pat. No. 9,186,921.

(51) Int. Cl.

| | |
|---|---|
| ***B41J 19/00*** | (2006.01) |
| ***B41J 19/14*** | (2006.01) |
| ***B41J 2/045*** | (2006.01) |
| ***B41J 11/42*** | (2006.01) |
| ***B41J 19/20*** | (2006.01) |
| ***B41J 25/00*** | (2006.01) |

(52) U.S. Cl.
CPC ..... *B41J 2/04505* (2013.01); *B41J 2/04586* (2013.01); *B41J 11/42* (2013.01); *B41J 11/425* (2013.01); *B41J 19/202* (2013.01); *B41J 25/001* (2013.01); *B41J 2/04501* (2013.01)

(58) Field of Classification Search
CPC combination set(s) only.
See application file for complete search history.

(56) References Cited

U.S. PATENT DOCUMENTS

| | | | |
|---|---|---|---|
| 6,189,993 | B1 | 2/2001 | Mantell |
| 6,217,150 | B1 | 4/2001 | Heydinger |
| 6,260,940 | B1 | 7/2001 | Yamada et al. |
| 6,575,568 | B1 | 6/2003 | Hiramatsu et al. |
| 7,914,112 | B2 | 3/2011 | Hayashi et al. |
| 9,186,921 | B2 * | 11/2015 | Verdugo et al. |
| 2011/0267392 | A1 | 11/2011 | Borrell et al. |
| 2011/0273504 | A1 | 11/2011 | Boesten et al. |

FOREIGN PATENT DOCUMENTS

| | | |
|---|---|---|
| WO | WO2009127261 | 10/2009 |

* cited by examiner

*Primary Examiner* — Huan Tran
(74) *Attorney, Agent, or Firm* — Mannava & Kang P.C.

(57) ABSTRACT

A method to control a printer carriage in which the printer carriage is controlled to move along a first axis at a first predetermined speed when a printhead, installed on the printer carriage, is ejecting printing fluid in a print zone. The printer carriage is moveable bidirectionally along the first axis in swaths to enable the printhead to print in the print zone. The printer carriage is also controlled to move along the first axis at a second predetermined speed, higher than the first predetermined speed, when the printhead is not ejecting printing fluid in the print zone.

20 Claims, 9 Drawing Sheets

TO CONTROL A PRINTER CARRIAGE

PRIORITY

This application is a continuation application of commonly assigned and copending U.S. patent application Ser. No. 13/873,783, filed on Apr. 30, 2013, the disclosure of which is hereby incorporated by reference in its entirety.

BACKGROUND

Printer apparatus, such as inkjet printers, include a printer carriage on which a printhead is installed. The printer carriage is moveable bidirectionally along a scan axis and enables the printhead to provide printing fluid (such as ink) along the width of the media. The printer apparatus is arranged to move the media through the printer apparatus along a media axis and thereby enable the printhead to provide printing fluid along the length of the media.

BRIEF DESCRIPTION OF FIGURES

Reference will now be made by way of example only to the accompanying drawings in which.

DETAILED DESCRIPTION

Figure 1:
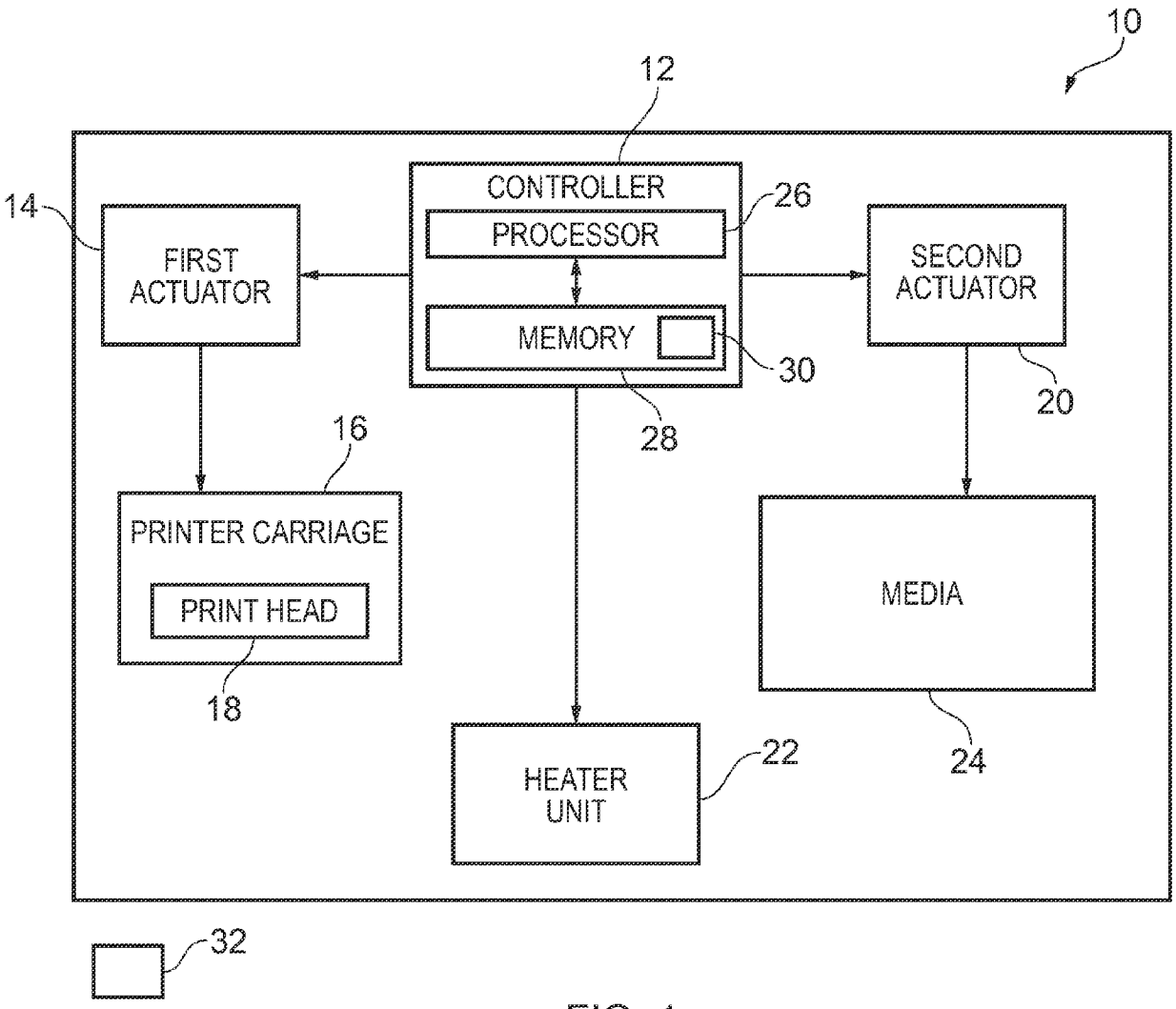
FIG. 1 illustrates a schematic diagram of printer apparatus according to an example.

FIG. 1 illustrates a schematic diagram of printer apparatus 10 including a controller 12, a first actuator 14, a printer carriage 16, a printhead 18, a second actuator 20 and a heater unit 22. The printer apparatus 10 may include a single housing for housing the controller 12, the first actuator 14, the printer carriage 16, the printhead 18, the second actuator 20 and the heater unit 22 therein. In other examples, the printer apparatus 10 may comprise separate housings for different components (for example, a first housing for the controller 12, the first actuator 14, the printer carriage 16, the printhead 18 and the second actuator 20, and a second housing the heater unit 22).

The printer apparatus 10 may be a module in some examples. As used here, 'module' refers to a unit or apparatus that excludes certain parts/components that would be added by an end manufacturer or a user. For example, where the printer apparatus 10 is a module, the printer apparatus 10 may only include the controller 12 (the first actuator 14, the printer carriage 16, the printhead 18, the second actuator 20 and the heater unit 22 being added by an end manufacturer).

In overview, the printer apparatus 10 is arranged to receive media 24 (which may be a sheet or web of media), and print on the media 24 using printing fluid. The printed media 24 is then provided to the heater unit 22 which then dries the printed media 24. The printer apparatus 10 then outputs the printed media 24 for collection by a user.

The implementation of the controller 12 can be in hardware alone (for example, a circuit, a processor and so on), have certain aspects in software including firmware alone or can be a combination of hardware and software (including firmware).

The controller 12 may be implemented using instructions that enable hardware functionality, for example, by using executable computer program instructions in a general-purpose or special-purpose processor 26 that may be stored on a computer readable storage medium 28 (disk, memory and so on) to be executed by such a processor 26.

The processor 26 is configured to read from and write to the memory 28. The processor 26 may also comprise an output interface via which data and/or commands are output by the processor 26 and an input interface via which data and/or commands are input to the processor 26.

The memory 28 stores a computer program 30 comprising computer program instructions that control the operation of the printer apparatus 10 when loaded into the processor 26. The computer program instructions 30 provide the logic and routines that enables the printer apparatus 10 to perform the methods illustrated in FIGS. 3 and 6. The processor 26 by reading the memory 28 is able to load and execute the computer program 30.

The printer apparatus 10 may therefore comprise: at least one processor 26; and at least one memory 28 including computer program code 30; the at least one memory 28 and the computer program code 30 configured to, with the at least one processor 26, cause the printer apparatus 10 at least to perform: controlling the printer carriage 16 to move along a first axis at a first predetermined speed when the printhead 18, installed on the printer carriage 16, is ejecting printing fluid in a print zone, the printer carriage 16 being moveable bidirectionally along the first axis in swaths to enable the printhead 18 to print in the print zone; and controlling the printer carriage 16 to move along the first axis at a second predetermined speed, higher than the first predetermined speed, when the printhead 18 is not ejecting printing fluid in the print zone.

The computer program 30 may arrive at the printer apparatus 10 via any suitable delivery mechanism 32. The delivery mechanism 32 may be, for example, a non-transitory computer-readable storage medium, a computer program product, a memory device, a record medium such as a compact disc read-only memory (CD-ROM) or digital versatile disc (DVD) or a solid state memory, an article of manufacture that tangibly embodies the computer program 30. The delivery mechanism 32 may be a signal configured to reliably transfer the computer program 30. The printer apparatus 10 may propagate or transmit the computer program 30 as a computer data signal.

Although the memory 28 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware.

The first actuator 14 is configured to move the printer carriage 16 relative to the media 24. The first actuator 14 is arranged to move the printer carriage 16 at a plurality of different speeds (that is, the first actuator 14 may move the printer carriage 16 at two or more speeds that are greater than zero kilometers per hour). The first actuator 14 may be any suitable actuator or combination of actuators and may include at least one servo motor for example. The controller 12 is arranged to control the first actuator 14 to move the printer carriage 16.

The printer carriage 16 may have any suitable structure for receiving the printhead 18 and enabling the printhead 18 to be installed therein. In some examples, the printer carriage 16 is coupled to the first actuator 14 via a carriage belt (not illustrated in FIG. 1).

The printhead 18 is installed in the printer carriage 16 and is arranged to provide printing fluid. The printhead 18 may be any suitable printhead and may be an inkjet printhead that includes a plurality of nozzles for ejecting printing fluid. The printing fluid may be any suitable ink or combination of inks and may include, for example, latex ink. The controller 12 is arranged to control the printhead 18 to provide printing fluid.

The second actuator 20 is configured to move the media 24 under the printer carriage 16 to enable the printhead 18 to print along the length of the media 24. The second actuator 14 is arranged to move the media 24 at a plurality of different speeds (that is, the second actuator 20 may move the media 24 at two or more speeds that are greater than zero kilometers per hour). The second actuator 20 may be any suitable actuator or combination of actuators and may include at least one roller for moving the media 24. The controller 12 is configured to control the second actuator 20 to move the media 24.

The heater unit 22 is arranged to receive the printed media 24 and provide heat to printed media 24. The heat from the heater unit 22 may increase the rate at which the printing fluid on the media 24 dries. Where the printing fluid includes latex ink, the heat from the heater unit 22 dries and cures the latex ink.

Figure 2:
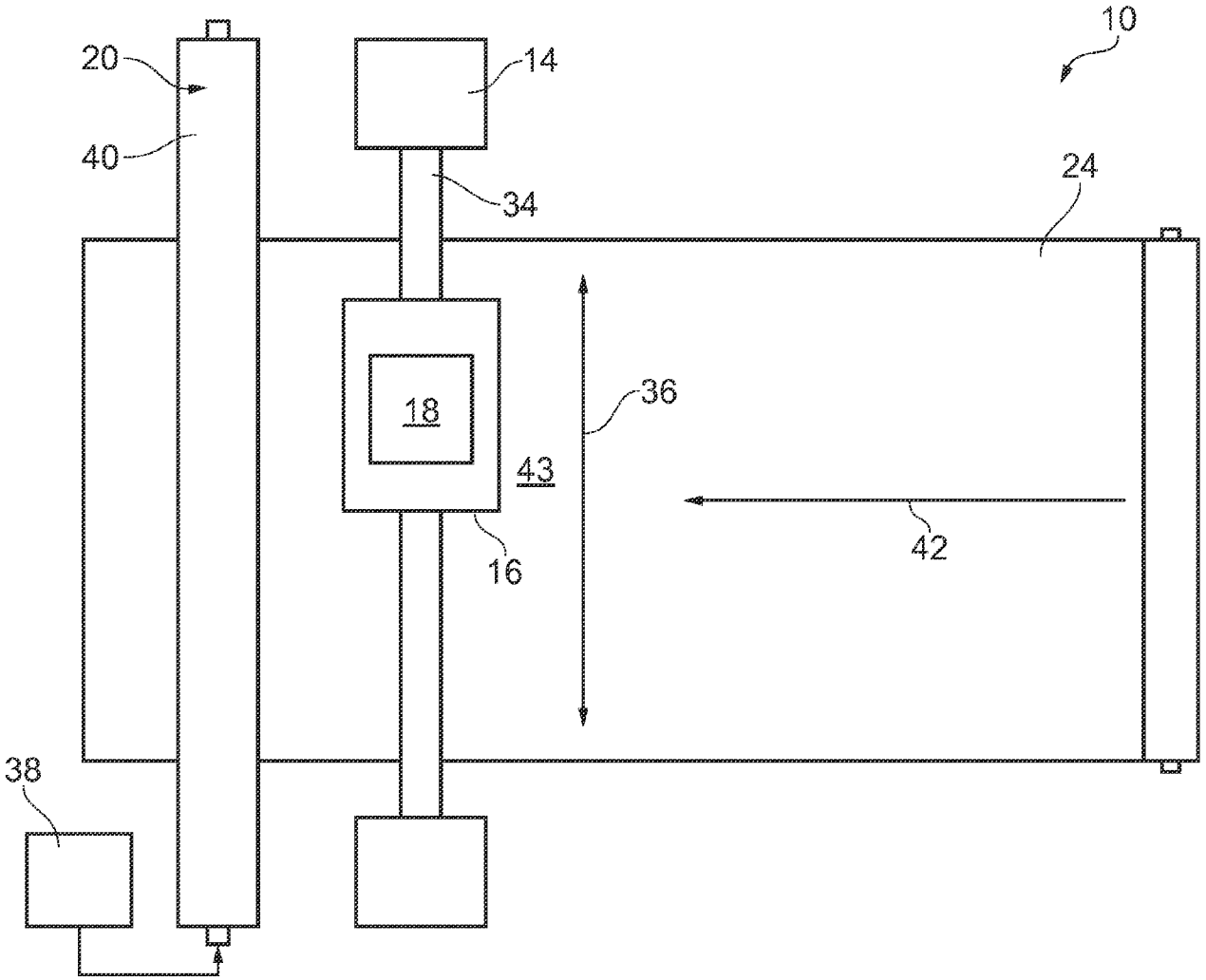
FIG. 2 illustrates a plan view of printer apparatus according to an example.

FIG. 2 illustrates a plan view of the printer apparatus 10 according to an example. In this Fig, the first actuator 14, the second actuator 20, the printer carriage 16, the printhead 18, and the media 24 are illustrated.

The first actuator 14 includes a servo motor 14 and a carriage belt 34. The servo motor 14 is coupled to the printer carriage 16 via the carriage belt 34. The first actuator 14 is arranged to move the printer carriage 16 bidirectionally in swaths along a first axis 36 (which may also be referred to as a scan axis 36) and therefore across the width of the media 24. As used here, a swath of the printer carriage 16 is where the printer carriage 16 moves back and forth across the width of the media 24. For example, a first swath of the printer carriage 16 covers a first portion of the media 24, and a second swath of the printer carriage 16 covers a second different portion of the media 24.

The second actuator 20 includes a servo motor 38 and a roller 40. The roller 40 is arranged to receive the media 24 and the servo motor 38 is arranged to rotate the roller 40 and thereby move the media 24 along a second axis 42 (which may also be referred to as the media axis 42) and under the printer carriage 16. The second axis 42 is orthogonal to the first axis 36. In some examples, the second actuator 20 may include a plurality of servo motors 38 and rollers 40 distributed throughout the printer apparatus 10 that function to move the media 24 along the second axis 42 and through the printer apparatus 10.

The movement of the printer carriage 16 and the media 24 by the first and second actuators 14, 20 enables the printhead 18 to eject printing fluid over a print zone 43 of the media 24. In some examples, the print zone 43 may be equal to the width of the media 24. In other examples, the print zone 43 may be smaller than the width of the media 24 (that is, at least one margin may be positioned adjacent the print zone 43 in which the printhead 18 does not eject printing fluid). The print zone 43 may include areas that receive printing fluid from the printhead 18 and other areas that do not receive printing fluid from the printhead 18. Therefore, the print zone may be defined as an area in which the printhead 18 may eject printing fluid.

Figure 3:
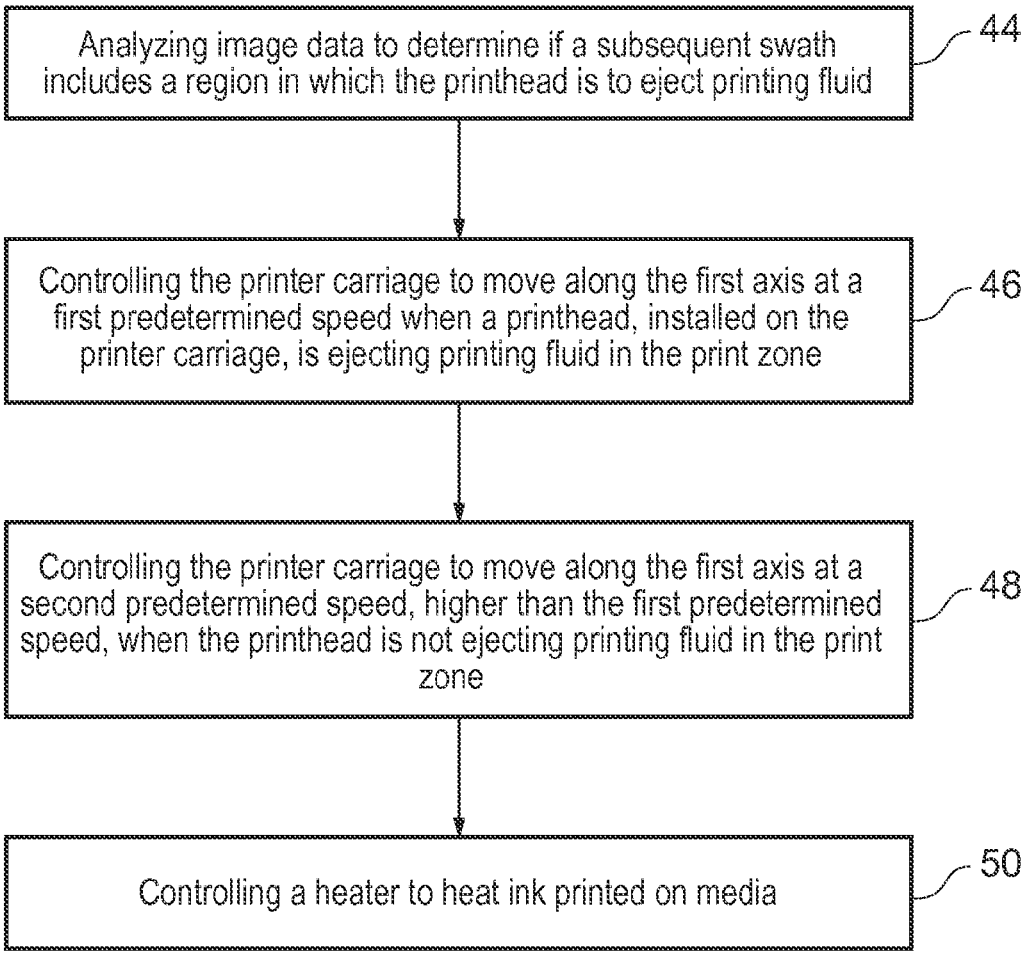
FIG. 3 illustrates a flow diagram of a method of controlling a printer carriage according to an example.

FIG. 3 illustrates a flow diagram of a method of controlling the printer carriage 16 according to an example.

At block 44, the controller 12 analyses image data (which may be stored on the memory 28 for example) to determine if at least one subsequent swath to be printed includes a region in which the printhead 18 is to eject printing fluid. For example, the controller 12 may analyze the next swath in the image data, a plurality of swaths in the image data, or may analyze all of the swaths in the image data prior to performing block 46 or block 48.

At block 46, the controller 12 uses the analysis performed in block 44 to control the printer carriage 16 to move along the first axis 36 at a first predetermined speed when the printhead 18 is ejecting printing fluid in the print zone 43.

At block 48, the controller 12 uses the analysis performed in block 44 to control the printer carriage 16 to move along the first axis 36 at a second predetermined speed, higher than the first predetermined speed, when the printhead 18 is not ejecting printing fluid in the print zone 43.

Blocks 46 and 48 may be performed by the controller 12 a plurality of times and in different orders depending upon the image data. For example, where a swath does not include any region that is to receive printing fluid, the controller 12 may control the printer carriage 16 to move at the second predetermined speed in that swath. By way of another example, where a swath includes a region that is to receive printing fluid, and a region that is not to receive printing fluid, the controller 12 may control the printer carriage 16 to move at the first predetermined speed over the region to receive printing fluid, and control the printer carriage 16 to move at the second predetermined speed over the region that is not to receive printing fluid.

In some examples, the first predetermined speed is the normal print mode speed of the printer apparatus 10 and the second predetermined speed is faster than the normal print mode speed of the printer apparatus 10. The controller 12 may also be arranged to control the first actuator 14 to move the printer carriage 16 at a plurality of different speeds that are greater than the first predetermined speed.

At block 50, the controller 12 controls the heater unit 22 to provide heat to the printing fluid on the media 24. In some examples, the printer apparatus 10 may not include a heater unit 22 and in these examples, the method does not include block 50.

In some examples, the first predetermined speed (that is, the normal, or default, print mode speed of the printer apparatus 10) of block 46 may not be the lowest speed of the printer carriage 16. In these examples, the controller 12 uses the analysis performed in block 44 to control the printer carriage 16 to move along the first axis 36 at a predetermined speed that is lower than the first predetermined speed when the printhead 18 is ejecting printing fluid in the print zone 43 at a higher printing fluid density. For example, the first predetermined speed may be used when the printing fluid density is 70% of the maximum printing fluid density, and a lower predetermined speed may be used when the printing fluid density is greater than 70% of the maximum printing fluid density. This feature may be advantageous in that it may provide a faster default print mode speed.

Figure 4:
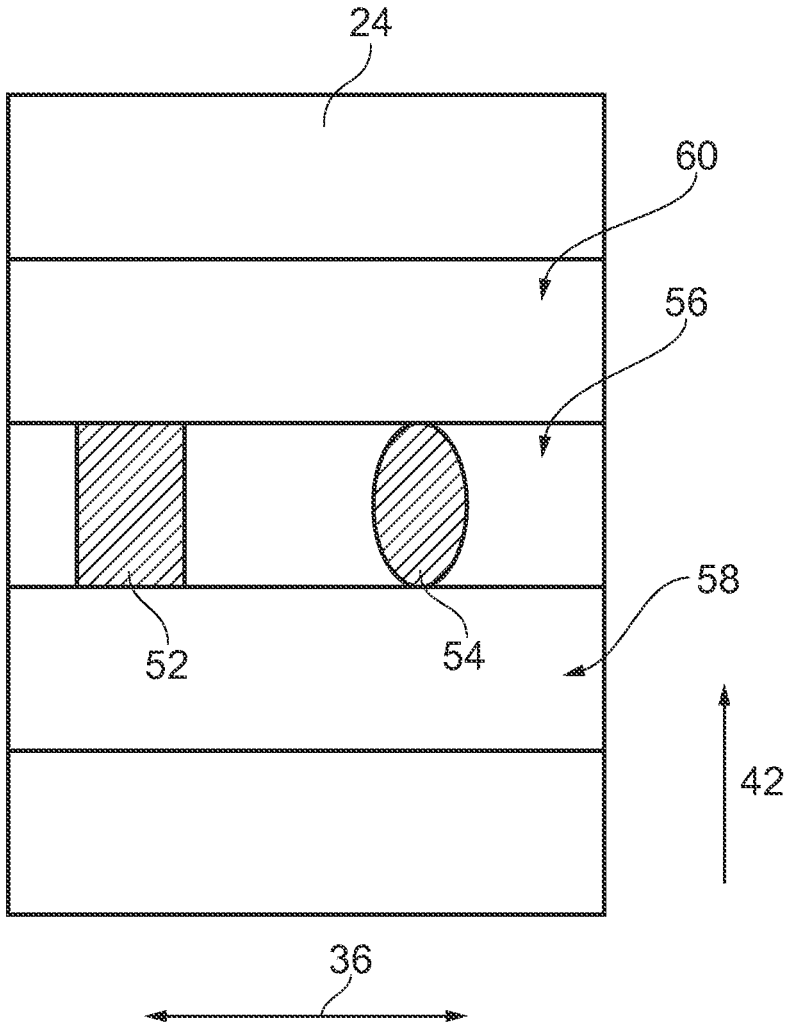
FIG. 4 illustrates a plan view of printed media according to an example.

FIG. 4 illustrates a plan view of printed media 24 according to an example. The media 24 includes a first region 52 that has received printing fluid and a second region 54 that has a received printing fluid. The first region 52 and the second region 54 were printed in one swath 56 of the printer carriage 16 (either in one or two passes) and are spaced apart from one another. The swaths 58, 60 which are before and after the swath 56 respectively do not include any regions that have received printing fluid.

Figure 5:
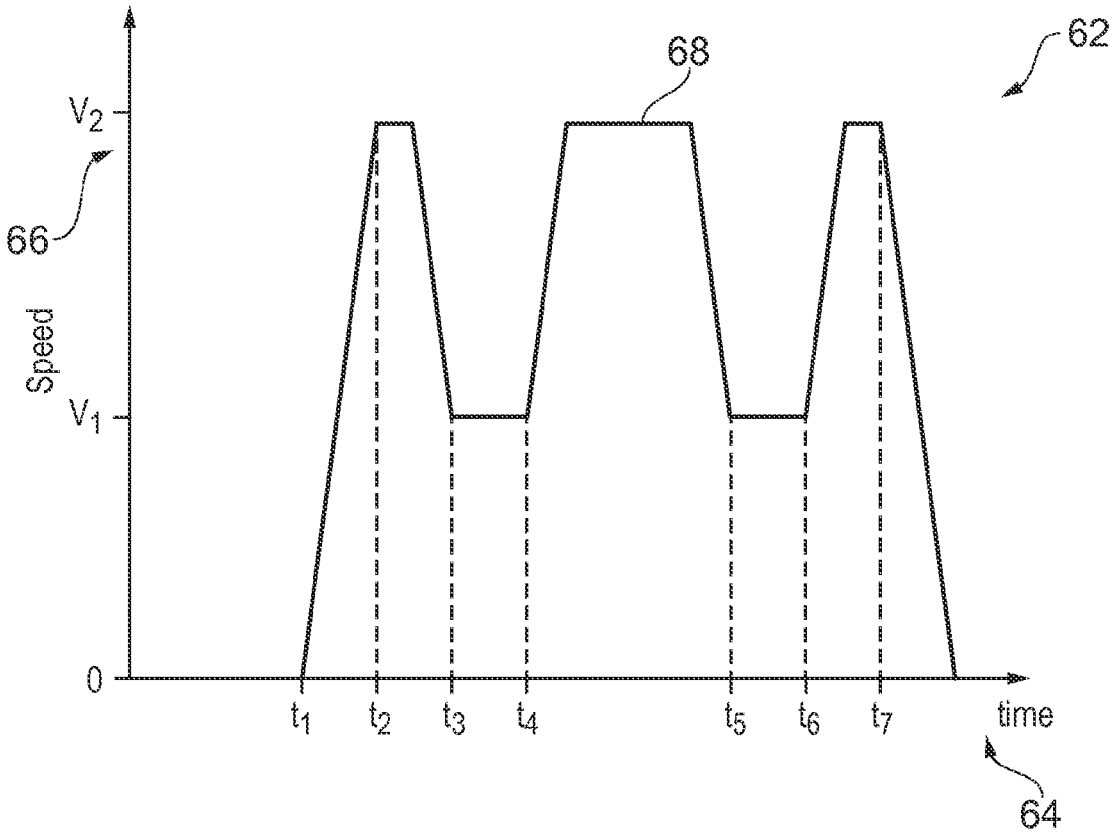
FIG. 5 illustrates a graph of carriage speed versus time for printing the printed media illustrated in FIG. 4.

FIG. 5 illustrates a graph 62 of carriage speed versus time for printing the swath 56 of the printed media 24 illustrated in FIG. 4. The graph 62 includes a horizontal axis 64 for time, a vertical axis 66 for speed, and a line 68 that represents the speed of the printer carriage 16 over time.

At time t1, the printer carriage 16 is positioned outside of the print zone 43 and the controller 12 controls the first actuator 14 to move the printer carriage 16 at the second predetermined speed V2. Between times t1 and t2, the printer carriage 16 is accelerated to the second predetermined speed and the printer carriage 16 enters the print zone 43 at time t2. The printer carriage 16 moves at the second predetermined speed V2 for a period of time and the controller 12 then controls the first actuator 14 to move the printer carriage 16 at the first predetermined speed V1.

At time t3, the printer carriage 16 is moving at the first predetermined speed V1 and the controller 12 controls the printhead 18 to eject printing fluid onto the media 24 and over the first region 52. At time t4, the controller 12 controls the printhead 18 to stop ejecting printing fluid and controls the first actuator 14 to move the printer carriage 16 at the second predetermined speed V2.

The printer carriage 16 moves at the second predetermined speed V2 for a period of time and the controller 12 then controls the first actuator 14 to move the printer carriage 16 at the first predetermined speed V1. At time t5, the printer carriage 16 is moving at the first predetermined speed V1 and the controller 12 controls the printhead 18 to eject printing fluid onto the media 24 and over the second region 54. At time t6, the controller 12 controls the printhead 18 to stop ejecting printing fluid and controls the first actuator 14 to move the printer carriage 16 at the second predetermined speed V2. At time t7, the printer carriage 16 exits the print zone 43 and the controller 12 controls the first actuator 14 to stop the movement of the printer carriage 16.

The velocity profile illustrated in FIG. 5 may be repeated where the first region 52 and the second region 54 are printed in two passes of the printer carriage 16. Where the first and second regions 52, 54 are printed in a single pass of the printer carriage 16, the controller 12 may control the first actuator 14 to return the printer carriage 16 back to the starting position (that is, the position of the printer carriage 16 at time t1) at the second predetermined speed.

The printer apparatus 10 is advantageous in that where the printhead 18 is not ejecting printing fluid, the controller 12 controls the first actuator 14 to move the printer carriage 16 at a greater speed than when the printhead is ejecting printing fluid. This may result in the printer carriage 16 requiring less time to complete a swath of printing and may consequently increase the throughput of media through the printer apparatus 10. Therefore, the printer apparatus 10 may have increase productivity, and due to the greater throughput of media, provide a reduced cost for printing.

Figure 6:
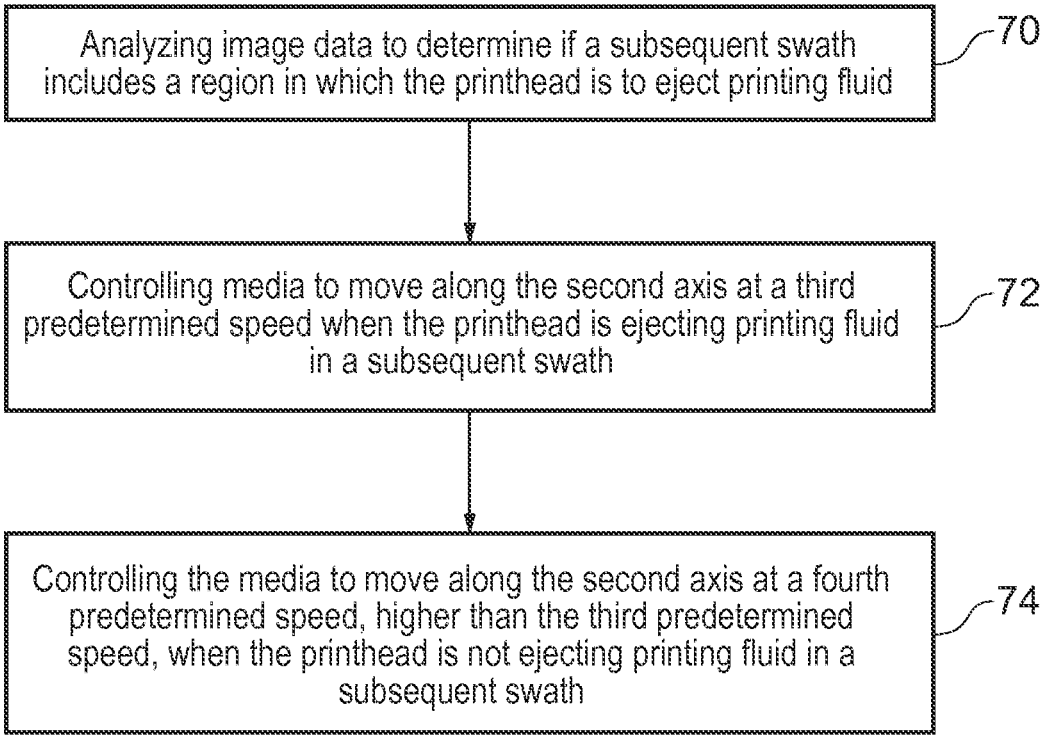
FIG. 6 illustrates a flow diagram of a method of controlling the movement of media according to an example.

FIG. 6 illustrates a flow diagram of a method of controlling the movement of media according to an example. At block 70, the controller 12 analyses image data (stored on the memory 28 for example) to determine if at least one subsequent swath includes a region in which the printhead is to eject printing fluid.

At block 72, the controller 12 uses the analysis performed in block 70 to control the media 24 to move along the second axis 42 at a third predetermined speed when the printhead is ejecting printing fluid in a subsequent swath.

At block 74, the controller 12 uses the analysis performed in block 70 to control the media 24 to move along the second axis 42 at a fourth predetermined speed, higher than the third predetermined speed, when the printhead is not ejecting printing fluid in a subsequent swath.

Blocks 72 and 74 may be performed by the controller 12 a plurality of times and in different orders depending upon the image data. In some examples, the third predetermined speed may be the normal print mode media axis speed of the printer apparatus 10 and the fourth predetermined speed is faster than the normal print mode media axis speed of the printer apparatus 10. The controller 12 may also be arranged to control the second actuator 20 to move the media 24 at a plurality of different speeds that are greater than the third predetermined speed.

In some examples, the controller 12 may control the media 24 to move along the second axis 42 at the fourth predetermined speed when the printhead 18 is not ejecting printing fluid in a plurality of subsequent swaths which is greater than a threshold number of swaths. If the number of swaths is less than the threshold number, the controller 12 controls the media 24 to move along the second axis 42 at the third predetermined speed.

Figure 7:
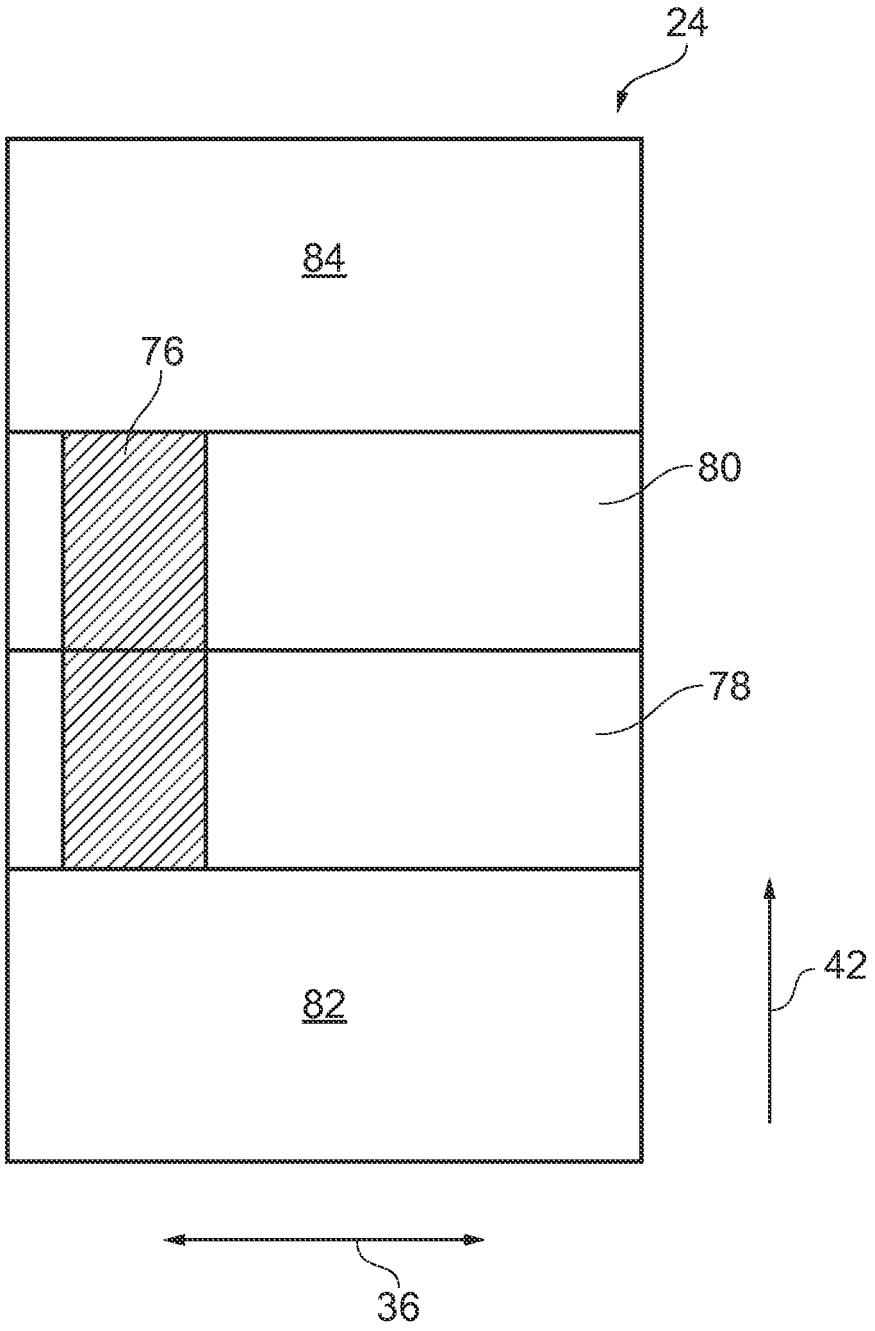
FIG. 7 illustrates a plan view of printed media according to another example.

FIG. 7 illustrates a plan view of printed media 24 according to an example. The media 24 includes a region 76 that has received printing fluid and was printed in two swaths 78, 80 of the printer carriage 16 (either in one or two passes of the printer carriage). The swaths 82, 84 which are before and after the swaths 78, 80 respectively do not include any regions that have received printing fluid.

Figure 8:
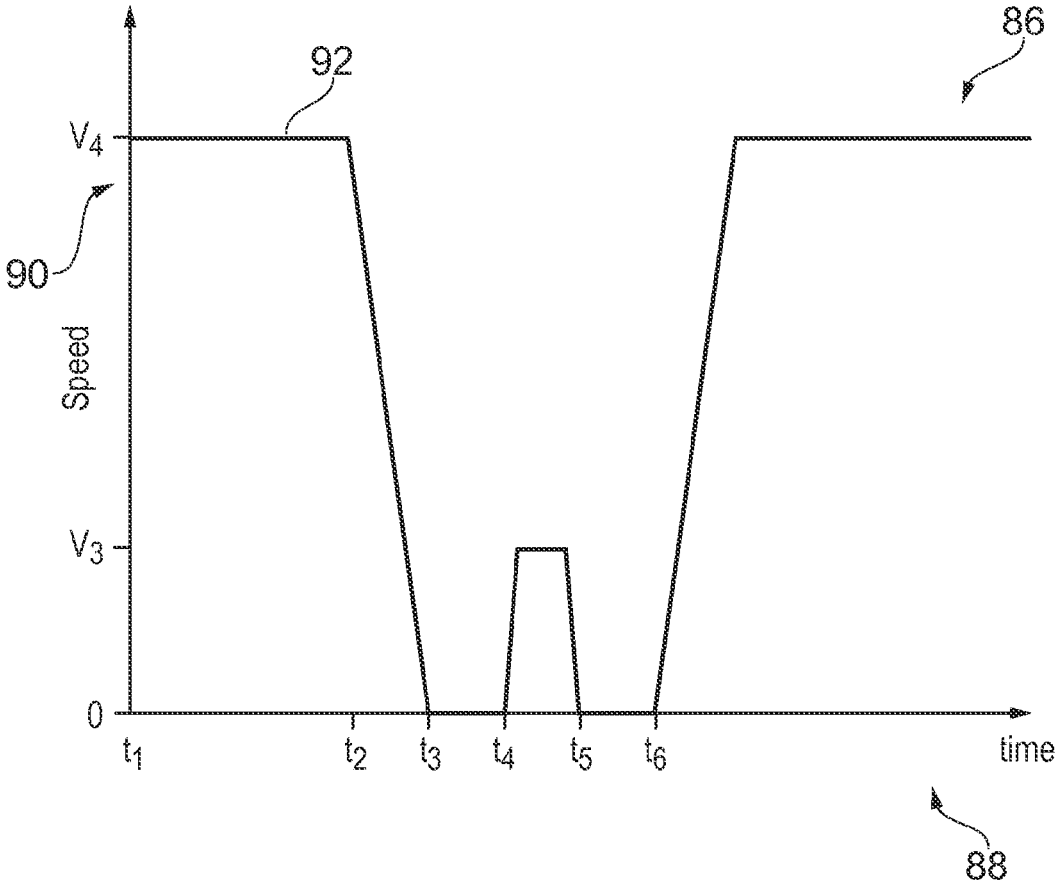
FIG. 8 illustrates a graph of media speed versus time for printing the printed media illustrated in FIG. 7.

FIG. 8 illustrates a graph 86 of media speed versus time for printing the media 24 illustrated in FIG. 7. The graph 86 includes a horizontal axis 88 for time, a vertical axis 90 for speed, and a line 92 that represents the speed of the media 24 over time.

At time t1, the controller 12 controls the movement of the media 24 to move at the fourth predetermined speed since the swath 82 does not include a region that receives printing fluid from the printhead 18. At time t2, the controller 12 controls the movement of the media 24 so that the media 24 is brought to a stop at time t3. Between times t1 and t3, the printer carriage 16 remains stationary.

Between times t3 and t4, the controller 12 controls the printer carriage 16 to move along the first axis 36 in swath 78 to enable the printhead 18 to eject printing fluid within region 76 (the media remaining stationary). The printer carriage 16 is moved at varying speeds in accordance with the preceding paragraphs and as illustrated in FIG. 3. At time t4, the controller 12 controls the movement of the media 24 to move at the third predetermined speed V3 and then controls the movement of the media 24 so that the media 24 is brought to a stop at time t5.

Between times t5 and t6, the controller 12 controls the printer carriage 16 to move along the first axis 36 in swath 80 to enable the printhead 18 to eject printing fluid within region 76 (the media remaining stationary). The printer carriage 16 is moved at varying speeds in accordance with the preceding paragraphs and as illustrated in FIG. 3. At time t6, the controller 12 controls the movement of the media 24 to move at the fourth predetermined speed V4 since the swath 84 does not include a region that receives printing fluid from the printhead 18.

The printer apparatus 10 is advantageous in that where the printhead 18 is not ejecting printing fluid in a subsequent swath, the controller 12 controls the second actuator 20 to move the media 24 at a greater speed than when the printhead is ejecting printing fluid in a subsequent swath. This may result in an increase in the throughput of media through the printer apparatus 10.

The blocks illustrated in FIGS. 3 and 6 may represent steps in a method and/or sections of code in the computer program 30. The illustration of a particular order to the blocks does not necessarily imply that there is a required or preferred order for the blocks and the order and arrangement of the block may be varied. Furthermore, it may be possible for some blocks to be omitted.

Although examples of the present invention have been described in the preceding paragraphs, it should be appreciated that modifications to the examples given can be made without departing from the scope of the invention as claimed.

Figure 9:
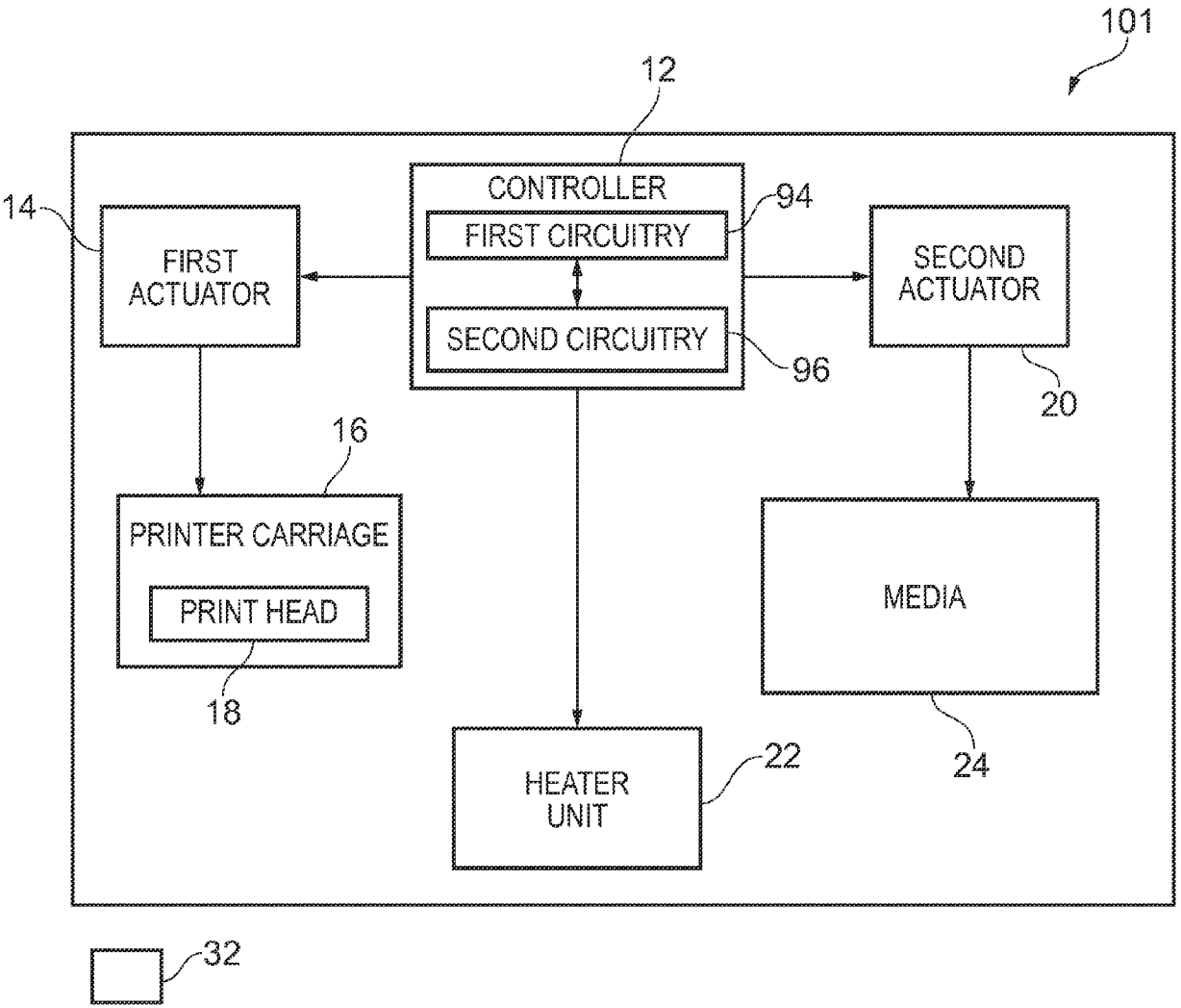
FIG. 9 illustrates a schematic diagram of another printer apparatus according to an example.

For example, FIG. 9 illustrates a schematic diagram of another printer apparatus 101 according to an example. The printer apparatus 101 is similar to the printer apparatus 10 and where the features are similar, the same reference numerals are used.

The printer apparatus 101 differs from the printer apparatus 10 in that the controller 12 includes first circuitry 94 and second circuitry 96. The first circuitry 94 is arranged to block 44 illustrated in FIG. 3 and block 70 illustrated in FIG. 6. The second circuitry 96 is arranged to perform blocks 46, 48 in FIG. 3 and blocks 72 and 74 illustrated in FIG. 6.

In some examples, the first circuitry 94 is an application specific integrated circuit (ASIC) and is arranged to determine if a swath includes a region in which the printhead is to eject printing fluid by performing non-zero-row-logging.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A method to control a printer carriage, the method comprising:

determining whether a printhead is to eject printing fluid onto a medium in a subsequent swath;

controlling the medium to move along a second axis at a first predetermined speed in response to a determination that the printhead is to eject printing fluid in the subsequent swath; and controlling the medium to move along the second axis at a second predetermined speed, higher than the first predetermined speed, in response to a determination that the printhead is not to eject printing fluid in the subsequent swath.

2. The method of claim 1, further comprising:

controlling a printer carriage to move along a first axis to enable the printhead, installed on the printer carriage, to eject printing fluid in a print zone over a media in swaths, wherein the second axis is perpendicular to the first axis.

3. The method of claim 1, wherein determining whether the printhead is to eject printing fluid onto the medium in a subsequent swath further comprises determining whether the printhead is to eject printing fluid in a plurality of subsequent swaths greater than a predetermined threshold number of swaths, and wherein controlling the medium further comprises controlling the medium to move along the second axis at the second predetermined speed in response to a determination that the printhead is not to eject printing fluid in a plurality of subsequent swaths greater than the predetermined threshold number of swaths.

4. The method of claim 3, wherein controlling the medium further comprises controlling the medium to move along the second axis at the first predetermined speed in response to a determination that the printhead is not to eject printing fluid in a plurality of subsequent swaths that is less than the predetermined threshold number of swaths.

5. The method of claim 1, wherein determining whether the printhead is to eject printing fluid onto the medium in a subsequent swath further comprises analyzing image data to determine whether the subsequent swath includes a region in which the printhead is to eject printing fluid.

6. The method of claim 1, wherein the printing fluid is latex ink and the method further comprises controlling a heater to heat latex ink printed on medium.

7. The method of claim 1, further comprising:

controlling the medium to move along the second axis at one of a plurality of predetermined speeds that is greater than the first predetermined speed in response to a determination that the printhead is not to eject printing fluid in the subsequent swath.

8. An apparatus comprising:

a controller; and a memory on which is stored machine readable instructions that are to cause the controller to:

determine whether the printhead is to eject printing fluid onto a medium in a subsequent swath;

control the medium to move along a second axis at a first predetermined speed in response to a determination that the printhead is to eject printing fluid in the subsequent swath; and control the medium to move along the second axis at a second predetermined speed, higher than the third predetermined speed, in response to a determination that the printhead is not to eject printing fluid in the subsequent swath.

9. The apparatus of claim 8, wherein the machine readable instructions are further to cause the controller to control a printer carriage to move along a first axis to facilitate deposition, by the printhead installed on the printer carriage, of printing fluid in a print zone on a medium in swaths, wherein the second axis is perpendicular to the first axis.

10. The apparatus of claim 8, wherein to determine whether the printhead is to eject printing fluid onto the medium in a subsequent swath, the machine readable instructions are further to cause the controller to determine whether the printhead is to eject printing fluid in a plurality of subsequent swaths greater than a predetermined threshold number of swaths, and to control the medium to move along the second axis at the second predetermined speed in response to a determination that the printhead is not to eject printing fluid in a plurality of subsequent swaths greater than the predetermined threshold number of swaths.

11. The apparatus of claim 10, wherein to control the medium, the machine readable instructions are further to control the medium to move along the second axis at the first predetermined speed in response to a determination that the printhead is not to eject printing fluid in a plurality of subsequent swaths that is less than the predetermined threshold number of swaths.

12. The apparatus of claim 8, wherein to determine whether the printhead is to eject printing fluid onto the medium in a subsequent swath, the machine readable instructions are further to analyze image data to determine whether the subsequent swath includes a region in which the printhead is to eject printing fluid.

13. The apparatus of claim 8, wherein the printing fluid is latex ink and the machine readable instructions are further to control a heater to heat latex ink printed on medium.

14. The apparatus of claim 8, wherein the machine readable instructions are further to cause the controller to control the medium to move along the second axis at one of a plurality of predetermined speeds that is greater than the first predetermined speed in response to a determination that the printhead is not to eject printing fluid in the subsequent swath.

15. An apparatus comprising:

a printer carriage to receive a printhead;

a first actuator to move a medium along a medium axis, first circuitry to analyze image data to determine whether a subsequent swath includes a region in which the printhead is to eject printing fluid; and second circuitry to control a second actuator to control the speed of movement of the medium using the analysis of the first circuitry, wherein the second circuitry is to control the second actuator to move the medium at a first predetermined speed when the printhead is to eject printing fluid in the print zone in the subsequent swath and to move the medium at a second predetermined speed when the printhead is not to eject printing fluid in the print zone in the subsequent swath, wherein the second predetermined speed is higher than the first predetermined speed.

16. The apparatus of claim 15, further comprising:

a heater unit to provide heat to printed medium.

17. The apparatus of claim 16, wherein the printing fluid comprises latex ink and the heater unit is to heat cure latex ink printed on medium.

18. The apparatus of claim 15, wherein the first circuitry is an application specific integrated circuit and is to determine if the subsequent swath includes a region in which the printhead is to eject printing fluid by performing non-zero-row-logging.

19. The apparatus of claim 15, further comprising:

a first actuator to move the printer carriage bidirectionally along a scan axis in swaths to enable the printhead to print in a print zone over the medium, wherein the medium axis is perpendicular to the scan axis.

20. The apparatus of claim 15, wherein the first circuitry is further to determine whether the printhead is to eject printing fluid in a plurality of subsequent swaths greater than a predetermined threshold number of swaths, and wherein the second circuitry is further control the second actuator to move the medium at the second predetermined speed in response to a determination by the first circuitry that the printhead is not to eject printing fluid in a plurality of subsequent swaths greater than the predetermined threshold number of swaths.

* * * * *